US008038549B2

(12) United States Patent
Vann

(10) Patent No.: US 8,038,549 B2
(45) Date of Patent: Oct. 18, 2011

(54) BASKETBALL SHOOTING TRAINING AID AND METHOD FOR ITS USE

(76) Inventor: Kayode Teddy Vann, New York, NY (US)

( * ) Notice: Subject to any disclaimer, the term of this patent is extended or adjusted under 35 U.S.C. 154(b) by 0 days.

(21) Appl. No.: 12/826,304

(22) Filed: Jun. 29, 2010

(65) Prior Publication Data

US 2010/0273585 A1 Oct. 28, 2010

Related U.S. Application Data

(63) Continuation of application No. 12/398,830, filed on Mar. 5, 2009, now Pat. No. 7,771,293.

(51) Int. Cl.
*A63B 69/00* (2006.01)

(52) U.S. Cl. ..... 473/450; 473/422; 473/447

(58) Field of Classification Search ..... 473/450, 473/458, 464, 447, 212–214, 220, 224, 221; 434/247–257; 463/48, 36, 37
See application file for complete search history.

(56) References Cited

U.S. PATENT DOCUMENTS

| | | | | | |
|---|---|---|---|---|---|
| 2,064,603 | A * | 12/1936 | Harrison | 434/252 |
| 3,820,783 | A | 6/1974 | Caveness | |
| 4,330,123 | A * | 5/1982 | Kleinerman | 473/63 |
| 4,665,388 | A * | 5/1987 | Ivie et al. | 340/573.1 |
| 4,699,379 | A * | 10/1987 | Chateau et al. | 473/59 |
| 4,743,028 | A * | 5/1988 | Harrison | 473/212 |
| 4,938,476 | A * | 7/1990 | Brunelle et al. | 482/148 |
| 5,149,085 | A | 9/1992 | Sanchez | |
| 5,236,190 | A | 8/1993 | Moss | |
| 5,354,050 | A | 10/1994 | McCarthy | |
| 5,472,205 | A * | 12/1995 | Bouton | 473/222 |
| 5,509,809 | A * | 4/1996 | Clay | 434/252 |
| 5,544,877 | A | 8/1996 | Brownell | |
| 5,607,361 | A * | 3/1997 | Mastandrea et al. | 473/207 |
| 5,876,292 | A | 3/1999 | Hamilton | |
| 6,050,963 | A * | 4/2000 | Johnson et al. | 600/595 |
| 6,148,280 | A | 11/2000 | Kramer | |
| 6,487,906 | B1 * | 12/2002 | Hock | 73/379.01 |
| 6,834,436 | B2 * | 12/2004 | Townsend et al. | 33/512 |
| 9,618,844 | | 7/2005 | Socci | |
| 7,616,097 | B1 * | 11/2009 | Whang | 340/321 |
| 2007/0066415 | A1 * | 3/2007 | Hou et al. | 473/219 |

* cited by examiner

*Primary Examiner* — Mitra Aryanpour
(74) *Attorney, Agent, or Firm* — Brown & Michaels, PC

(57) ABSTRACT

The present invention provides a shooting aid apparatus for basketball players including a device worn by a basketball player to aid the player's shooting forearm to be kept parallel to the vertical centerline of the body during the shooting motion without any apparatus restraints. The centerline of the body is an imaginary line dividing the player vertically down the middle of his or her body. The shooting aid comprises a sleeve adapted to fit around the forearm or wrist of the shooting arm of the basketball player. The sleeve carries a light that brightly illuminates in response to the forearm of the shooter being in a vertical position.

7 Claims, 2 Drawing Sheets

BASKETBALL SHOOTING TRAINING AID AND METHOD FOR ITS USE

PRIORITY CLAIM

This application is a continuation of and claims priority to U.S. patent application Ser. No. 12/398,830 filed on Mar. 5, 2009, now U.S. Pat. No. 7,771,293 which claims priority to U.S. patent application Ser. No. 11/164,434, filed on Nov. 22, 2005, both of which are incorporated herein by reference in their entirety.

SUMMARY OF THE INVENTION

The present invention relates to the field of sports training devices, and more particularly to a basketball shooting training aid.

Basketball is one of the top sports in the world. Points are predominately scored by shooting the basketball through a hoop generally mounted ten feet above the playing surface. Excellent shooting form and technique increases the player's ability to score points.

Numerous methods of shooting have been developed over the years, and some are still widely used today. For example, there are shots known as the lay up, hook shot, the one hand set shot, two hand set shot, the underhand shot, the one hand push shot, the one hand jump shot, the dunk shot, the foul shot, and the finger roll. Of all these shots, the shots that incorporate the techniques used in the one hand push shot are mostly used in the one hand jump shot, the one hand set shot, and foul shot. These techniques are frequently used and have developed into an increased importance in scoring in the modern game of basketball.

The proper techniques used in the one hand push shot with the opposite hand used as a prerelease stabilizer or guide is critical to achieving effectiveness and efficiency in scoring points. In the preferred method for executing a one hand push shot with opposite hand used as a pre-release stabilizer or guide, the forearm of the shooting arm is kept parallel to the center line of the body during the shooting motion. The centerline of the body is an imaginary line dividing the player vertically down the middle of his or her body. When the forearm of the shooting is not aligned with the centerline when shooting, the basketball has the tendency to stray from its proper shooting trajectory. This tendency causes a decrease in the percentage of shots that fall through the hoop.

DESCRIPTION OF RELATED ART

As can be seen by reference to the following U.S. Pat. Nos. 3,820,783; 5,149,085; 5,236,190; 5,544,877 and 5,876,292, the prior art is replete with myriad and diverse sports training devices.

While all of the aforementioned prior art constructions are adequate for the basic purpose and function for which they have been specifically designed, they are uniformly deficient with respect to their failure to provide a simple, efficient, and practical basketball shooting training aid.

As a consequence of the foregoing situation, there has existed a longstanding need for a new and improved basketball shooting training aid, and the provision of such a construction is a stated objective of the present invention.

BRIEF SUMMARY OF THE INVENTION

The present invention provides a shooting aid for basketball players including a device worn by a basketball player to aid the player's shooting forearm to be kept parallel to the centerline of the body during the shooting motion without any restraint on body motion. The centerline of the body is an imaginary line dividing the player vertically down the middle of his or her body. The shooting aid comprises a sleeve adapted to fit around the forearm or wrist of the shooting arm of the basketball player. In one embodiment, the sleeve carries a light that brightly illuminates in response to the forearm of the shooter being in a substantially vertical position, that is, the condition where the longitudinal axis of the adjustable sleeve is oriented substantially vertically in relation to gravity. Other embodiments can use other indicating devices, for example a sound. In other embodiments, the light or sound varies as the forearm approaches the vertical centerline.

Accordingly, it is an object of the present invention to provide a training aid for basketball players which is worn by the player and which serves to train the player to keep his elbow in toward the center of his body with the forearm vertical during the shooting motion illustrated in FIG. 2, which is the proper alignment when executing a basketball shot.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE PREFERRED EMBODIMENTS

Figure 1:
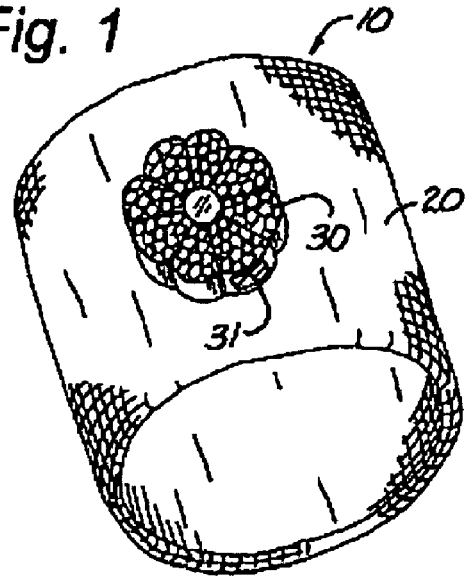
FIG. 1 is a perspective view of the basketball shooting training aid of the present invention.

As can be seen by reference to the drawings, and in particular to FIG. 1, the basketball shooting training aid that forms the basis of the present invention is designated generally by the reference number 10. The invention addresses the problem of effectively training and improving basketball players in acquiring the perfect shot. Players of all skill levels tend to have their shooting forearm stray from the centerline of the body (elbow moves away from the center of the body) during the shooting motion, thereby increasing the likelihood of an undesirable trajectory. If, however, the player's shooting forearm is kept parallel to the centerline of the body during the shooting motion, the proper ball trajectory is apt to ensue. Therefore, it is necessary to eliminate the common habit and tendency of the player's shooting forearm to stray from the centerline of the body if the correct shooting technique is to be attained.

Figure 2:
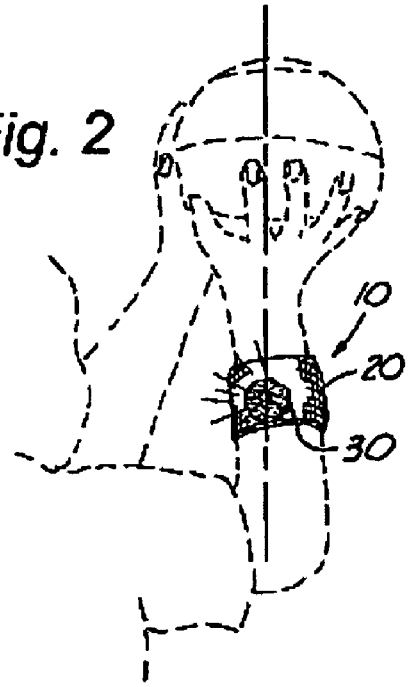
FIG. 2 is a perspective view showing the training aid positioned on the shooter's forearm and being brightly illuminated since the forearm is in a vertical position.
Figure 3:
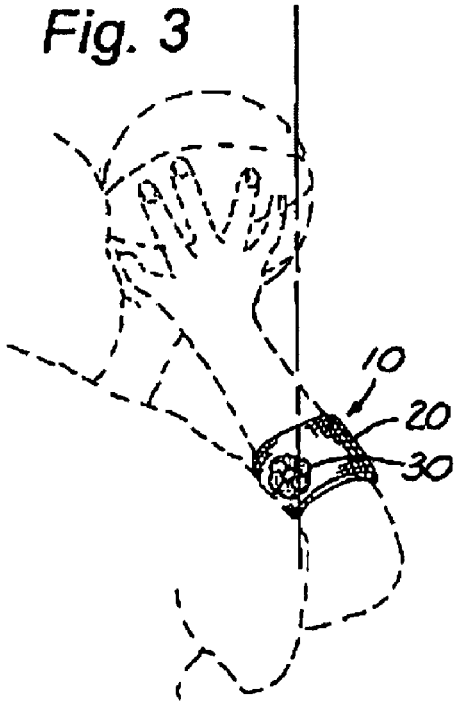
FIG. 3 is a perspective view similar to FIG. 2, but showing the shooter's forearm inclined to the left of vertical.
Figure 4:
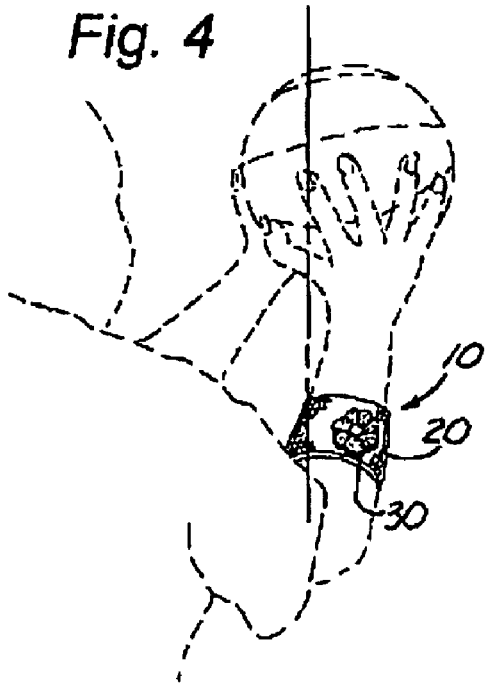
FIG. 4 is a perspective view similar to FIG. 2, but showing the shooter's forearm inclined to the right of vertical.

The invention relates to a training aid which is adapted to be worn by a basketball player for the purpose of developing a perfect basketball shot and for increasing shooting percentages by training a basketball player in proper shooting techniques. In a preferred embodiment, the apparatus 10 includes an elastic sleeve 20 that is stretchable and fits snugly over the forearm of the player's shooting arm. This elastic sleeve 20 carries a visual illuminated or audible indicator 30 which is visible or audible to the player during the act of shooting. This indicator 30 responds to the upward vertical position of the forearm of the shooter. This indicator (30) responds to the upward vertical position of the forearm of the shooter as detected by the positioning device that detects the orientational movement of the forearm as shown in FIGS. 2, 3 and 4. The indicator tells the player when the longitudinal axis of the forearm is substantially vertical, in other words, substantially parallel to the vertical axis, as shown in FIG. 2 by means of an indicating signal. In another view, when the longitudinal axis of the forearm is not substantially vertical, the indicator is not activated, as shown in FIGS. 3 and 4. A player can repeatedly perform a shooting motion while using the device 10 so that the player's muscles memorize and grow accustomed to the proper shooting technique, thus shooting the perfect shot.

Figure 5:
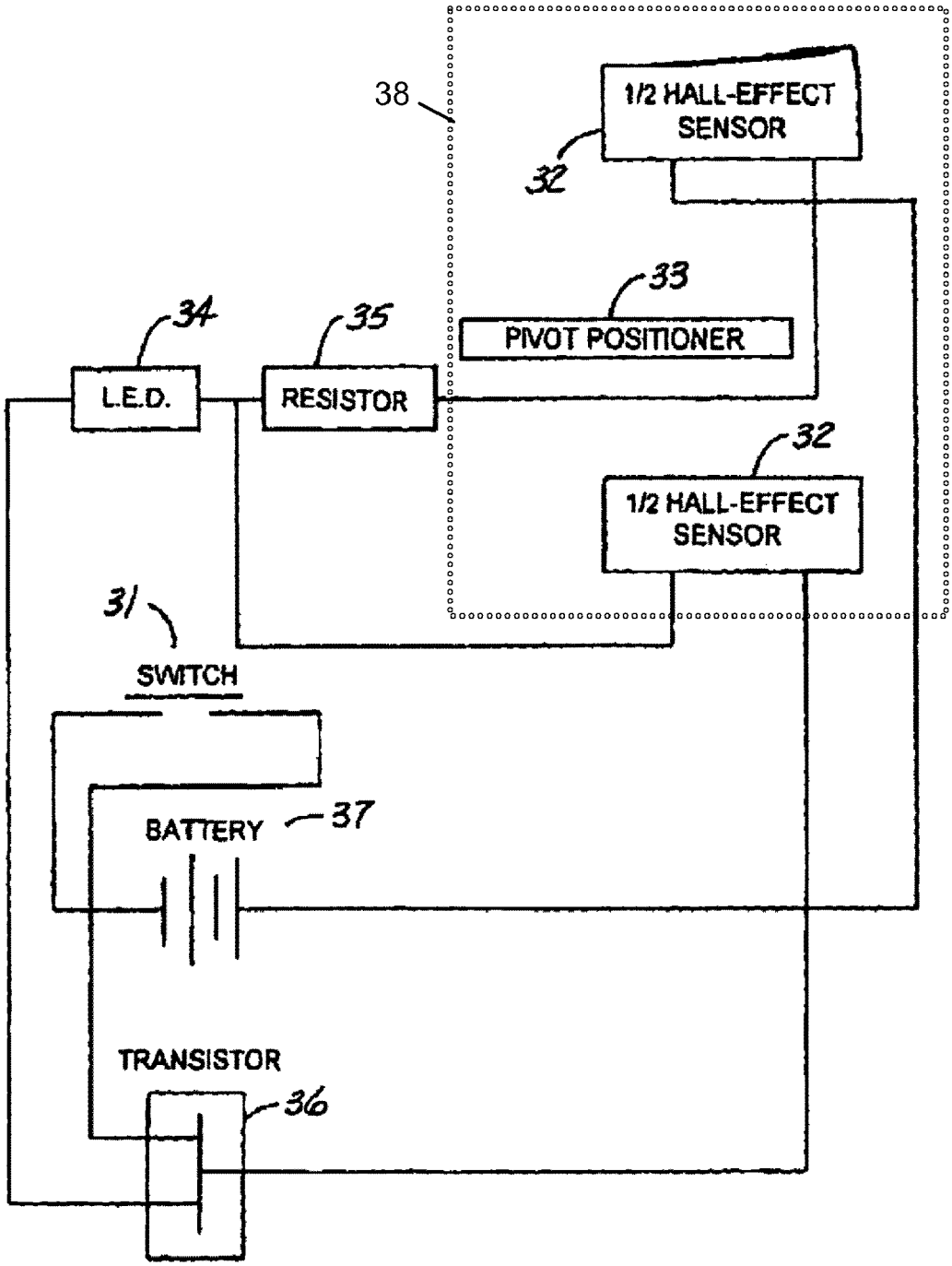
FIG. 5 is a circuit diagram showing the components of the visual illuminated forearm position indicator.

The electrical circuit for the indicator 30 is shown in FIG. 5. The circuit functions to visually display varying degrees of pitch (level) from negative values to neutral (zero) values to positive values or positive values to a neutral (zero) values to negative values. The circuit consists of an on-off switch 31, Hall Effect sensor 32, a pivoting positioner 33, LED 34 (light emitting diode), load resistor 35, driver transistor 36, and battery 37.

Closing the on-off switch 31 supplies current through a battery 37, driver transistor 36, Hall Effect sensor 32, load resistor 35, and LED 34. The physical position of the pivoting positioning device 33 relative to the Hall Effect sensor 32 in the positioning sensor 38 varies the amount of current that passes through the LED 34 varying its brightness, color and/or numerical degree read out. The Hall Effect sensor 32 senses the position of a movable actuator acting as a pivoting positioner 33 whose movement is determined by the orientation of the sensor to gravity. The actuator can be comprised of a magnet. As the magnet moves past the Hall Effect sensor 32, the effective resistance of the sensor changes. This variation is used by the circuit to determine electrically the orientation of the sensor and hence the sleeve and the arm. When the device is not level, the LED 34 displays varying degrees of brightness, color and/or numerical degree read out. When the device is perfectly level, the LED 34 reaches its maximum brightness, specific color and/or numerical degree read out as illustrated in FIG. 2. Besides a Hall sensor, other means of determining verticality may be used. For example, a leaf switch or other physical switching device actuated by a mechanical arm or pendulum whose weight makes it orient itself to indicate the direction of gravity. Alternatively, a fluid, like mercury or some other conducting fluid placed in a closed space with electrical contacts could be used to determine the direction of gravity. In another embodiment, a light passing through a fluid or passing through a hinged arm or pendulum that obscures a light detector except in a position that indicates the correct angle of the forearm relative to gravity may be used. Optionally, the opposite may be used: the sensor is obscured only at the point of correct orientation.

The light emits from the forearm position indicator 30 located on the elastic sleeve 20. In addition to the visual illuminated indicator, it is to be understood that audio and vibrating indicators could be added to augment the visual response. In other embodiments, the visual, audio and vibrating indicators may be used alone or in combination.

The light indicator 30 also serves as a physical reference for the player's point of release. In the preferred shooting motion, the light indicator 30 should be around eye level at the point of release of the basketball.

The electronic device may include an on and off switch, lock and unlock setting (making it detachable from the elastic sleeve and interchangeable with other elastic sleeves or attachments/adhesives), an adjustable leveler detector (for unleveled playing surfaces or for the player's preferred forearm shooting angle), and fashion modes (light and audio option that do not respond to the position of the forearm, but are used solely for the purpose of fun and fashion). In one embodiment, the circuit is adjustable so that the indicator is activated at some adjustable angle from the actual vertical centerline. In one embodiment, the position of the pivoting positioner and Hall sensor may be rotated slightly so that the detected vertical orientation of the positioner occurs when the longitudinal axis of the sleeve is off angle from the vertical centerline by a predetermined amount. This permits players to adjust the training aid to fit their particular anatomy or playing style.

The present invention satisfies the player's training needs by providing a shooting device to aid in the player's shooting forearm to be kept parallel to the centerline of the body during the shooting motion. Additionally, the invention accomplishes the preceding objectives by providing a device which possesses the additional attributes of being wearable on the shooting arm of the player, being gender neutral, being useful to players of all skill levels, being adaptable to a right or left handed player, being susceptible of ready and easy attachment to the arm of the player, being adjustable for various arm sizes, being safe, being capable of being worn for any type of shot, and being capable of being used with or without a ball.

The training aid provides a method and device to improve the accuracy of shooting a basketball, improve the arch of shooting a basketball, improve the point of release of the basketball during the player's shooting motion, and improve the positioning of a basketball on the backboard when shooting at an angle off the backboard.

The training aid is convenient, lightweight, stylish, safe and absorbent. While some basketball training aids are known and commercially available, most of the known devices are bulky and cumbersome. A need exists in the art for improved lightweight devices that are easier to use and help train basketball players in proper shooting technique without unnecessary physical restrictions or movement. This device relies on muscle memory and repetition. In particular, a device is needed which will not interfere in any way with the basketball, or with the normal freedom of motion of the shooter.

The use of this device does not interfere with other aspects of the basketball player's game such as dribbling the basketball, catching the basketball, rebounding the basketball, passing the basketball, playing defense, jumping, or dunking As a result, the shooting aid can be worn under actual game conditions which makes it unique and represents a distinct advantage over the prior art devices.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. An apparatus to aid a basketball player to keep his shooting forearm parallel to a vertical centerline of said basketball player body during a shooting motion, said apparatus comprising:

a sleeve to be worn on a forearm of said basketball player;

an electrical circuit attached to said sleeve;

a visual indicator coupled to said electrical circuit; and a positioning sensor for detecting relative orientation of a longitudinal axis of the sleeve in relation to gravity, having an indicating signal output electronically coupled to said electrical circuit which varies to indicate varying degrees of inclination from vertical;

such that the electrical circuit receives an indication of the orientation of the longitudinal axis of the sleeve relative to gravity from the indicating signal output of the positioning sensor and causes the visual indicator to output a variable visual signal perceptible by the player indicating the relative position of said basketball player's forearm position to a vertical position.

2. The apparatus according to claim 1 wherein the sleeve is in the form of an adjustable sleeve that is comprised of an elastic material.

3. The apparatus according to claim 1 where the visual indicator is in the form of a light capable of varying in color, and the variable visual signal indicating the relative position of said basketball player's forearm is in the form of varying a color of the light.

4. The apparatus according to claim 1 where the visual indicator is in the form of a light, and the variable visual signal indicating the relative position of said basketball player's forearm is in the form of varying a brightness of the light relative to the position of said basketball player's forearm to the vertical position.

5. The apparatus according to claim 1 in which the positioning sensor comprises a hall effect sensor and a pivoting positioner comprising a movable actuator which moves under the influence of gravity in the form of a magnet which moves relative to the hall effect sensor as the longitudinal axis of the sleeve is varied relative to the vertical.

6. The apparatus of claim 1 in which the positioning sensor is rotatable such that indication of the orientation of the longitudinal axis of the sleeve relative to gravity is offset by a predetermined amount.

7. The apparatus of claim 1, in which the electrical circuit is detachable from the sleeve.

* * * * *

UNITED STATES PATENT AND TRADEMARK OFFICE

CERTIFICATE OF CORRECTION

PATENT NO. : 8,038,549 B2
APPLICATION NO. : 12/826304
DATED : October 18, 2011
INVENTOR(S) : Kayode Teddy Vann It is certified that error appears in the above-identified patent and that said Letters Patent is hereby corrected as shown below:

Title Page, Item (63) Related U.S. Application Data, should read

-- Continuation of application No. 12/398,830, filed on Mar. 5, 2009, now Pat. No. 7,771,293, which is a continuation of application No. 11/164,434, filed on Nov. 22, 2005, now abandoned --

Signed and Sealed this
Twentieth Day of December, 2011

David J. Kappos

David J. Kappos
*Director of the United States Patent and Trademark Office*